United States Patent [19]

Philippe et al.

[11] 4,221,832

[45] Sep. 9, 1980

[54] SURFACE TREATMENT OF METAL STRIP

[75] Inventors: Paulus Philippe; Leroy Vincent; Henri Graas, all of Liege, Belgium

[73] Assignee: Centre De Recherches Metallurgiques-Centrum Voor Research In De Metallurgie, Brussels, Belgium

[21] Appl. No.: 20,198

[22] Filed: Mar. 13, 1979

[30] Foreign Application Priority Data

Mar. 14, 1978 [BE] Belgium ..... 864898
Mar. 14, 1978 [LU] Luxembourg ..... 79224

[51] Int. Cl.[2] ..... C23C 3/00

[52] U.S. Cl. ..... 427/319; 427/405; 427/436; 427/438; 148/18; 148/6.2; 204/38 B; 204/51

[58] Field of Search ..... 427/438, 319, 436, 229; 148/18, 142, 143, 144, 6.2; 204/38 B, 51

[56] References Cited

U.S. PATENT DOCUMENTS 2,955,959 10/1960 Du Rose ..... 427/438
3,155,532 11/1964 Basile ..... 427/319

FOREIGN PATENT DOCUMENTS 704806 3/1965 Canada ..... 427/319

*Primary Examiner*—Ralph S. Kendall
*Attorney, Agent, or Firm*—Holman & Stern

[57] ABSTRACT

Metal strip, particularly steel strip, is heated above 300° C. and immersed in a coating bath whose temperature is at least 80° C. and which contains at least one metal salt, the strip being coated with a metal layer, e.g. Ni-based or Cr-based, by the coating bath.

26 Claims, 5 Drawing Figures

SURFACE TREATMENT OF METAL STRIP

The present invention relates to a process for depositing a metal coating, especially a nickel or chromium-based coating, on metal strip, in particular on steel strip for deep drawing or stamping, in the course of a thermal treatment.

From the wide range of applications of a process consisting in a coating of a sheet of metal, and more particularly a sheet of steel, with a protective film, such as a film of nickel, we have directed our attention to:

- temporary surface protection between fabrication and use,
- primer coating facilitating the subsequent adhesion of a protective coating (phosphatization),
- precoat for enamelling.
- high-hardness coating to reduce the risk of seizure during deep drawing or stamping,
- coating with high resistance to hot and cold corrosion.

These manifold applications differ from each other solely with respect to the thickness and nature of the protective film to be deposited, especially of the nickel film.

U.S. Pat. Nos. 2,658,842 and 2,658,841 by GUTZEIT and No. 2,658,839 by TARLNEY have demonstrated the importance of nickelling methods by oxidation-reduction using solutions containing hypophosphite and a nickel salt. These authors have shown in particular the importance of using buffer components such as succinic and acetic acid and of working in a pH-range of the order of 4 to 6. The use of these solutions makes it possible to enhance the rate of deposition.

Moreover, we have already specified a continuous thermal treatment for sheet steel. The process consists essentially in heating the sheet to a temperature above its recrystallization temperature and cooling this sheet thereafter rapidly by immersing it in an aqueous bath held substantially at its boiling temperature.

We have also already considered the possibility of combining this thermal treatment with a surface treatment having for its object the coating of the strip with a metallic or non-metallic protective film (phosphatization).

The present invention is based on our observation in the course of experiments that the rate of deposition of nickel increases substantially when, instead of introducing the cold strip into the bath, the strip is preheated to a temperature above 300° C. This unexpected effect enables the metal strip to be coated with a relatively thick film in a very short time.

The invention will be described with reference to the accompanying drawings, in which.

Figure 1:
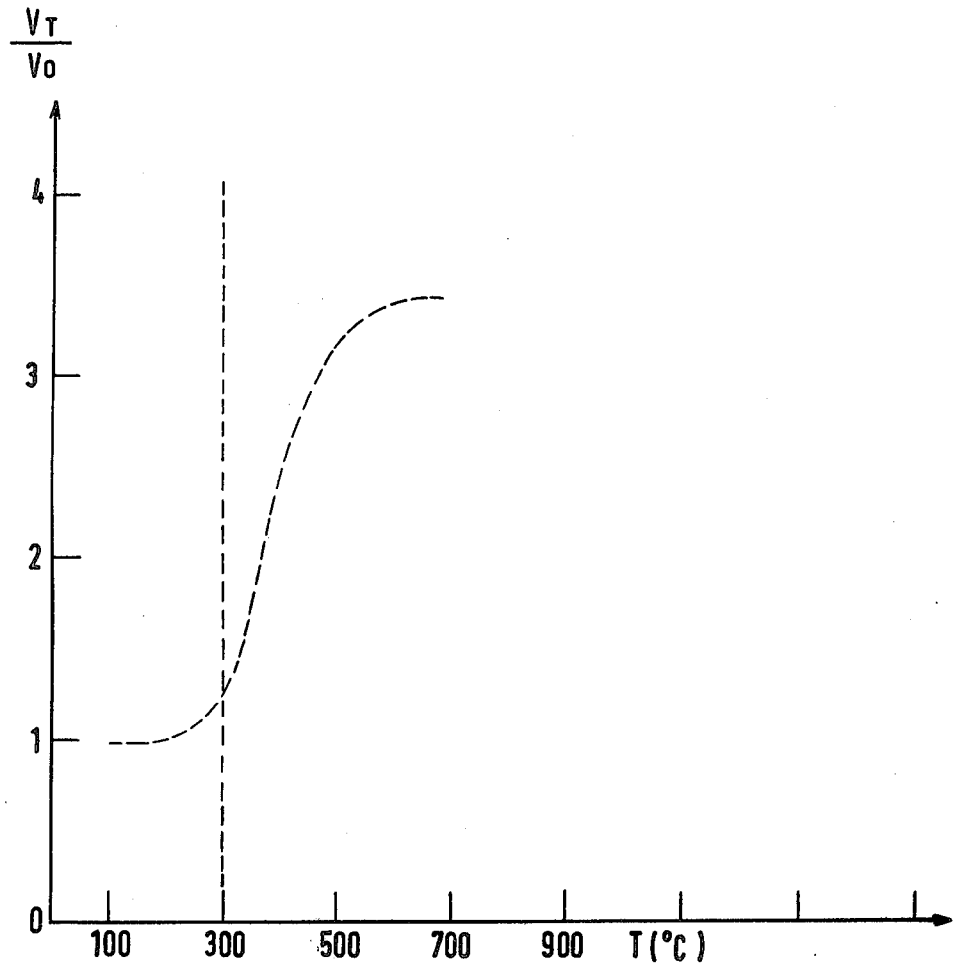
FIG. 1 is a graph of deposition rate versus strip temperature.

The graph of FIG. 1 of the accompanying drawings shows the evolution of the deposition rate $V_t$, relative to the rate $V_o$ at room temperature, as a function of the temperature T, ° C., of the strip at the instant of entry into the bath which consists of a well-known nickel-dip solution containing 24 g/l of $NiCl_2.6H_2O$, 24 g/l of $NaH_2PO_2.H_2O$, and 17 g/l of $Na_2C_4H_4O_4.6H_2O$, at a pH of 5.5 and a temperature of 98° C. It will be noted that the rate of deposition is greatly increased when the sheet metal is preheated prior to its introduction into the bath. Furthermore, the application of this method makes it possible to avoid completely the oxidation of the sheet which occurs normally when the sheet is quenched from a temperature above 500° C. in distilled water, for example.

On the basis of these considerations, the present invention provides a process for treating metal strip which conprises the following steps:

(a) The strip is heated to a temperature above 300° C., preferably under a protective atmosphere if the temperature exceeds 500° C., and (b) the strip is dipped into a bath having a temperature higher than or equal to 80° C., preferably higher than or equal to 90° C., and containing at least one metal salt intended for the coating of the strip.

According to a mode of execution of the invention, the coating material for the strip is nickel-based.

According to another mode of execution of the invention, the coating bath is:

either a solution containing:

a nickel salt such as $NiCl_2.6H_2O$ or $NiSO_4.6H_2O$ in a concentration within the range from 5 to 50 g/l, preferably from 15 to 35 g/l, a reducing agent such as sodium hypophosphite, $NaH_2PO_2.H_2O$, in a concentration greater than 0.1 mol/1;

a buffer component, generally constituted by an alkali salt of a dibasic organic acid having the general formula $CO_2H—(CH_2)_n—CO_2H$ in which n is from 1 to 4, and/or sodium hydroxyacetate ($NaC_2H_3O_3$), sodium acetate ($CH_3CO_2Na.3H_2O$), the alkali salts of glycolic acid ($HOCH_2COOH$), citric acid, lactic acid, propionic acid, etc.

or a solution for nickelling by displacement, containing simply a nickel salt and an acid, with a pH of 2 to 5.

The ratio between the quantity of nickel salt and the quantity of hypophosphite in mole/liter is advantageously in the range from 0.2 to 1.6, preferably from 0.3 to 0.8.

Also the buffer component is preferably present in the solution in a concentration comprised between 0.04 and 0.55 mole/liter.

Further, the pH of the solution is advantageously 3 to 6, and is adjusted with NaOH or $NH_4OH$.

In order to avoid the precipitation of iron and nickel phosphites, it is highly expedient to add substances such as lactic acid (a nickel-complexing agent) and tartaric acid (an iron-complexing agent), and also to filter continuously the solution, for example through activated charcoal, because the particles of the precipitates may constitute deposit seeds.

The necessary quantities of nickel salt and hypophosphite have to be added to avoid depletion of the bath during the process.

It is expedient to reduce the value of the ratio V/S of the volume V ($m^3$) of the solution in contact with the surface area S ($m^2$) treated to a value below 0.2.

According to a mode of execution of the invention, the strip to be treated is steel strip.

According to another mode of execution of the invention, the strip-coating operation is performed in the course of a thermal treatment in which the strip is introduced into a hot aqueous solution to cool it rapidly after recrystallization treatment and in which it is optionally introduced subsequently into another hot aqueous solution to effect its final cooling, after a thermal ageing process, one and/or the other of these solutions being used as a nickelling bath.

We have perfected modes of operation which allow one to regulate at will the thickness, the nature, and the hardness of the nickel film.

According to a first operational mode, in the case where a film of low thickness and high nickel content is required, a single immersion lasting between 0.5 and 40 seconds is performed, the length of this period being timed from the instant at which the temperature of the sheet reaches 150° C.

In this case, if the nickelling operation is combined with thermal treatment including immersion in a hot aqueous solution followed by an ageing operation, it is preferably to effect the nickelling operation, after the ageing operation, in order to avoid diffusion of the nickel.

In the same case, if the nickelling operation is combined with thermal treatment comprising quenching which follows the recrystallization heating, but without tempering (for example steels of high tensile strength) the nickelling is effected during the quenching.

Figure 2:
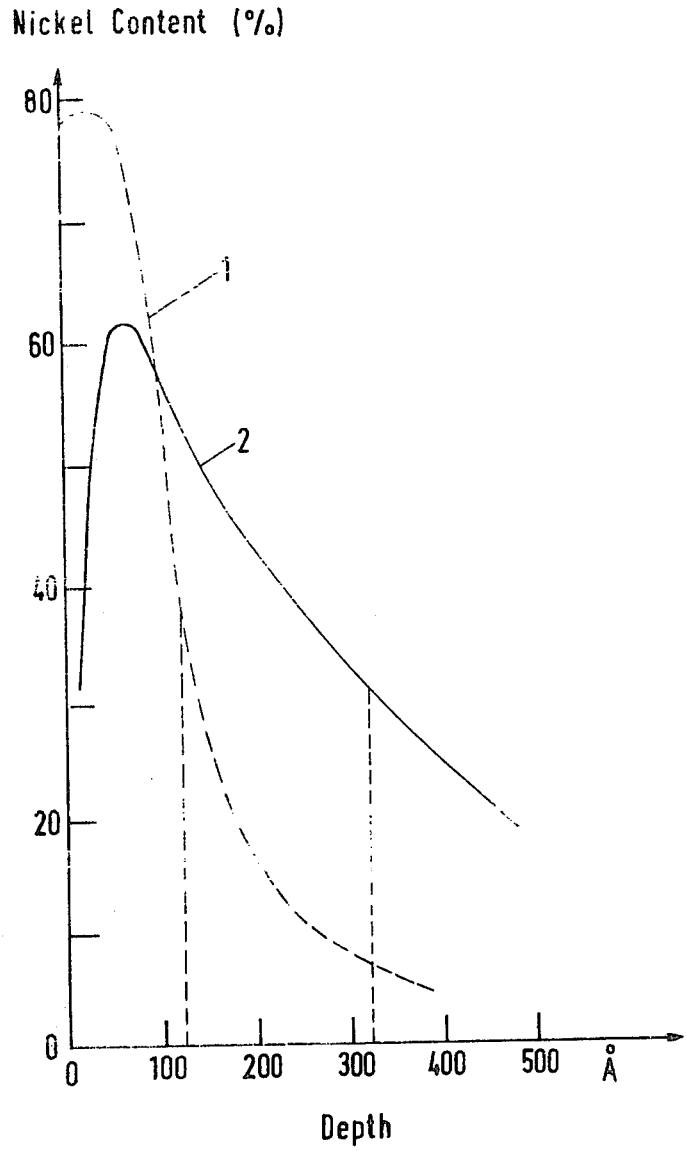
FIG. 2 is a graph of the nickel content of a coating versus depth.

We have examined the effect of tempering steel strip coated with nickel according to the present invention. The results of this investigation have been plotted in FIG. 2, where it is seen that the mean nickel content (%) diminishes, but that the thickness (Å) measured at mid-height of the concentration profile increases substantially; there is thus considerable diffusion within very brief periods of time (60 s at 450° C.). We have in addition observed a hardening effect of the tempering, due to formation of a second phase of the $Ni_3P$ type (curve 1: before annealing; curve 2; after annealing).

In the case where a nickel film of high thickness hardened by precipitation of phases such as $Ni_3P$, $Ni_2B$, $Ni_3B$ is required, immersion in the nickelling bath is followed by reheating in the range 300° to 500° C.

Figure 3:
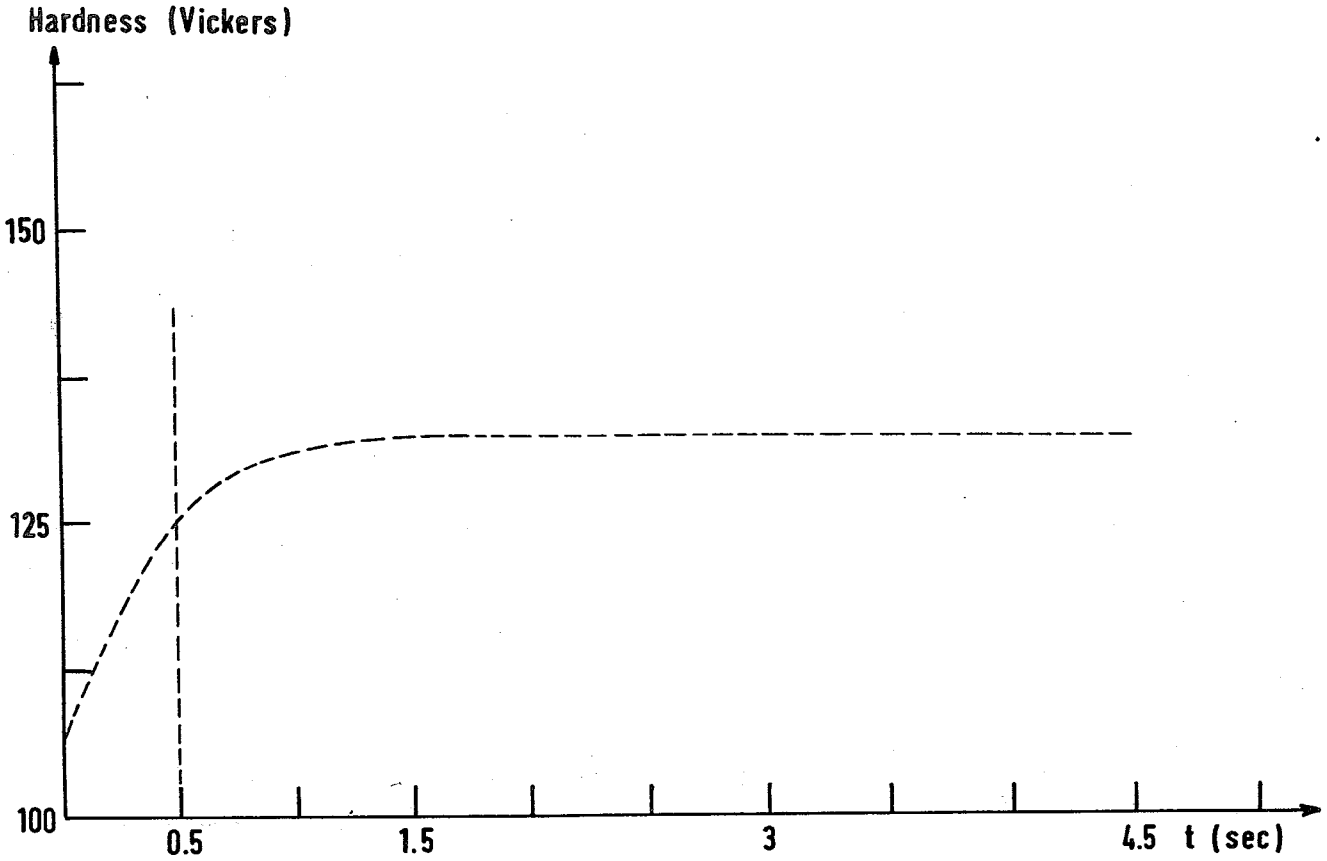
FIG. 3 is a graph of surface hardness versus residence time in a coating bath.

FIG. 3 shows, for the case of a very efficient solution and with an optimum adjustment of the V/S ratio, the evolution of the Vickers surface hardness as a function of the residence time of the strip at a temperature below 150° C.; it is seen that a residence of 0.5 s in the solution suffices to substantially increase the hardness (measured under a load of 50 g).

These considerations lead to the definition of a specific treatment of strip destined for deep drawing or stamping, comprising the following steps:

(a) heating to a temperature higher than the recrystallization temperature of the strip and sustaining this heating at this temperature for a sufficiently long period, this being effected under a protective atmosphere, (b) quenching in a nickelling bath as described above, the bath being kept at a temperature higher than or equal to 80° C., with a residence time between 0.5 and 40 s, at a temperature below 150° C., (c) very careful rinsing of the strip on leaving the bath, (d) tempering or ageing, consisting in heating the strip to a temperature in the range 300° to 500° C.; this ageing phase restores the ductility of the steel whilst hardening the nickel layer.

According to a first variant, the final cooling is effected in a conventional, well-known manner, for example by atmospheric gas streams.

According to a second variant, in the case where it is additionally desired to increase the weight of the nickel deposit, the strip is again dipped into a solution such as described above, after the ageing treatment.

According to a third variant, at least one of the two cooling phases is effected in a bath with a nickel salt and boron hydride or another boron compound destined to form as surface deposit a nickel-boron alloy which may contain, after thermal treatment, phases such as $Ni_2B$ or $Ni_3B$ which precipitate finely and increase the hardness.

According to another variant, the second cooling is carried out in an alkaline bath based on a nickel salt, hypophosphite, sodium citrate and/or ammonium chloride and/or sodium pyrophosphate with a pH of 8 to 11.

According to yet another variant, at least one of the two cooling operations is performed by dipping in an alkaline bath containing hydrazine or one of its salts with a nickel salt such as nickel acetate intended to form, in the outermost layer, a film of pure nickel.

In yet another variant, the second cooling is effected by dipping in a phosphatizing bath at a temperature above 80° C.

EXAMPLE

Samples of cold-rolled LD rimming steel strip 0.8 mm thick were subjected to the following different treatments:

(a) conventional annealing in a closed furnace:

($b_1$) heating to 700° C. in 40 s, kept at 700° C. for 60 s; quenching in a bath of boiling distilled water;

($b_2$) as above + ageing at 450° C.×60," final cooling by gas jets;

(c) heating to 700° C. in 40 s, under a protective atmosphere, holding at 700° C. for 60 s, dipping in a bath at 97° C. containing
24 g/l $NiCl_2.6H_2O$,
24 g/l $NaH_2PO_2.H_2O$,
20 g/l lactic acid,
the pH being adjusted to 5 by addition of NaOH;
the time in the bath was adjusted to ensure cooling to 150° C. and a residence time of
($C_1$) 0.5 s
($C_2$) 5 s
($C_3$) 10 s
($C_4$) 30 s
below this temperature;

($d_1$) to ($d_4$) as under ($c_1$) to ($c_4$) but with additional ageing for 60" at 450° C. and final cooling in air;

($e_1$) to ($e_4$) as under ($c_1$) to ($c_4$) but with ageing for 60" at 450° C. and final cooling by dipping in a bath containing 60 g/l Ni-acetate, 105 g/l glycolic acid, 27.5 g/l tetrasodium-EDTA, and 155 $cm^3/l$ of hydrazine hydrate; the temperature of the bath was 90° C. and its pH 11; the residence time of the sheet below 150° C. was of 5 s in each case.

RESULTS

| Treatment | final hardness (Vickers-50 g) | Oxidation test (1) | Phosphatization (2) |
|---|---|---|---|
| a | 87–97 | highly pitted | average |
| $b_1$ | 107 | oxide film unchanged | good |
| $b_2$ | 100 | some pitting | good |

RESULTS-continued

| Treatment | final hardness (Vickers-50 g) | Oxidation test (1) | Phosphatization (2) |
|---|---|---|---|
| $c_1$ | 107 | very slight pitting | good |
| $c_2$ | 110 | slightly dull | very good |
| $c_3$ | 116 | brilliant | very good |
| $c_4$ | 123 | brilliant | good |
| $d_1$ | 107 | brilliant | average |
| $d_2$ | 118 | brilliant | average |
| $d_3$ | 124 | brilliant | average |
| $d_4$ | 137 | brilliant | average |

(1) Oxidation in a bath of distilled water at pH5 for 3 hours at 100° C.
(2) Grip-secured corrosion test of phosphatic and paint protection after 240 hours exposure to saline mist (ASMB Standard 117).

It will be noted that the nature and the thickness of the nickel coating can be adjusted at will in order to obtain specific properties.

The scope of the present invention is not exceeded by improving the nickel layer with a copper layer designed to increase the adhesion of a subsequent coating such as those intended for enamelling purposes. This copper layer may be formed after one or other of the nickel deposits.

For the purpose of increasing the corrosion resistance, it is possible to add to the treatments described in the foregoing a chromatizing treatment in a solution containing $Na_2Cr_2O_7$ or $CrO_3$ in a concentration of 10 to 100 g/l, in the presence of $SO_4$ ions in a concentration approximately 100 times lower with a current density of the order of 10 A/dm$^2$, the strip being cathodic. This chromatizing treatment may be carried out during the first cooling and/or during the second cooling, or after the latter. The resulting advantage is one of covering the previously formed nickel layer with a layer of metallic chromium and/or with a layer of trivalent chromium oxide.

According to a particular advantageous variant, the coating of the strip may be chromium-based.

In recent years, numerous attempts have been made to produce steel sheet having a quality equivalent to that of tinplate, but without using tin; these research activities have led to several types of products designed as "tin-free". These coatings, produced on thin, annealed, skin-passed sheets, are based on chromium and chromium oxide. By way of examples, the following prior art processes with or without intervention of electrolysis, may be mentioned. namely:

1. Immersion in a bath of chromic acid with addition of reducing agents, such as sucrose, glucose, glycerole, and more generally polyhydric alcohols capable of ensuring a reduction of the hexavalent chromium in the course of subsequent thermal treatment carried out in most cases at a temperature below 200° C.
2. Immersion, with cathodic electrolysis, in chromic acid with addition of sulphuric acid. In general, the processes are classified as
   - two-step processes, consisting in a first immersion in a $CrO_3$ medium followed by a second immersion in a solution of hexavalent chromium, with cathodic polarization, the current densities being of the order of 40 A/dm$^2$, with treatment times of a few seconds.
   - single-step processes, by immersion in chromic acid under cathodic polarization.

However, the application of these different processes assumes preconditioning of the annealed and skin-passed strip, which is constituted by at least the following different phases; alkaline degreasing, rinsing, and pickling, followed again by rinsing.

These diverse operations are of course expensive and involve considerable expenditure in terms of equipment.

Furthermore, we have disclosed a continuous thermal treatment process making it possible to obtain the various qualities or tempers conforming to ASTM specifications and generally employed in the fabrication of tinplate. This process is characterised notably in the use of a water quench at a temperature above 75° C. and preferably close to boiling temperature, followed or not by a thermal ageing treatment according to the hardness of the sheet to be produced.

For the purpose of obtaining certain tempers, it is also possible to effect the cooling after ageing by quenching in an aqueous bath whose temperature is maintained above 75° C.

The present invention provides an improved process for coating metal strip with a chromium-based protective layer; this improved process consists in the combination of immersion in a hot aqueous bath and immersion in a chromium-containing solution. The hot bath contains chromic acid and optionally reducing agents such as sucrose, glucose, glycerol, and more generally polyhydric alcohols; the chromic acid concentration of this bath is preferably between 10 and 100 g/l.

Also the metal strip may be immersed into the bath under cathodic electrolysis, with addition of sulphuric acid, for example at a rate of 1/100 of the chromic acid content.

In a particular mode of execution of this immersion with cathodic electrolysis, the operation is carried out in two phases, the first of which is immersion in a $CrO_3$ medium titrating at 50 to 500 g/l and the second is immersion in a solution of hexavalent chromium under cathodic polarization.

In another form of execution of this process, the operation is carried out in a single phase by immersing the strip under cathodic polarization at low concentration with additions of sulphate, silicon fluoride, boron fluoride, etc.

We have in fact observed that the chromic acid bath generally employed was perfectly adapted to effect pickling of the surface of the quenched sheet prior to ensuring the deposition of chromium and chromium oxide layers. Experience has actually shown that the removability of the oxide layer formed during the quenching in a bath at a temperature close to the boiling temperature is particularly facilitated. Thus, by reason of its principle itself, the process of "quenching chromatization" allows one to avoid the surface-preparation stages mentioned above.

According to one mode of execution, the operation of coating of the strip is carried out during thermal treatment in the course of which the strip is introduced into a hot aqueous solution to cool it rapidly after its recrystallization treatment and in which the strip is optionally introduced subsequently into another aqueous hot solution to effect its final cooling, after thermal ageing treatment, one and/or the other of these solutions being used as chromatizing bath.

According to another mode of execution, if the chromatizing operation is combined with thermal treatment comprising quenching in hot aqueous solution followed by an ageing operation, it is preferable to effect the chromatizing operation after the ageing operation, in order to avoid the diffusion of chromium.

According to yet another mode of execution, if the chromatizing operation is combined with thermal treatment comprising quenching which follows recrystallizing heating, but without tempering (for example in the case of a steel with high tensile strength), the chromatization is carried out during the said quenching.

Figure 4:
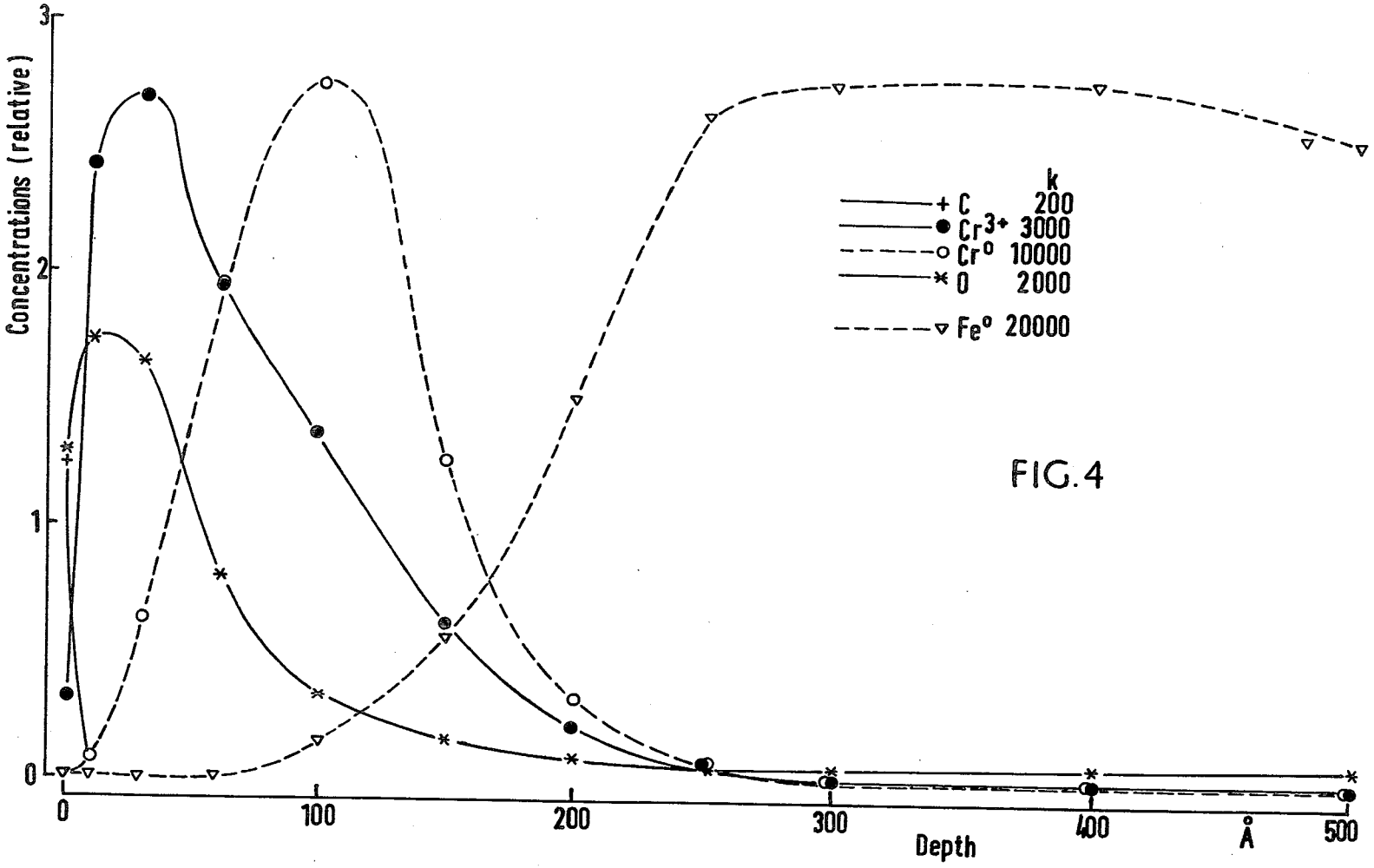
FIG. 4 is a graph concentration versus depth in a coating.

By way of example, FIG. 4 shows the concentration profiles of metallic chromium, trivalent chromium, oxygen, and iron as measured by photoelectric spectrometer, in the case of a sample treated in a bath of chromic acid at 98° C., having a concentration of 65 g/l, under a current density of 35 A/dm$^2$, and for a residence time of 3 seconds at a strip temperature below 150° C.

We have also verified that the nature of the layers formed during the "quenching-chromatization" treatment are not affected during the ageing treatment under reducing atmosphere which must be carried out in obtaining certain tempers; it is advisable to ensure that the dewpoint of these reducing atmospheres be from −10° to −40° C. in order to avoid oxidation of the deposits.

Figure 5:
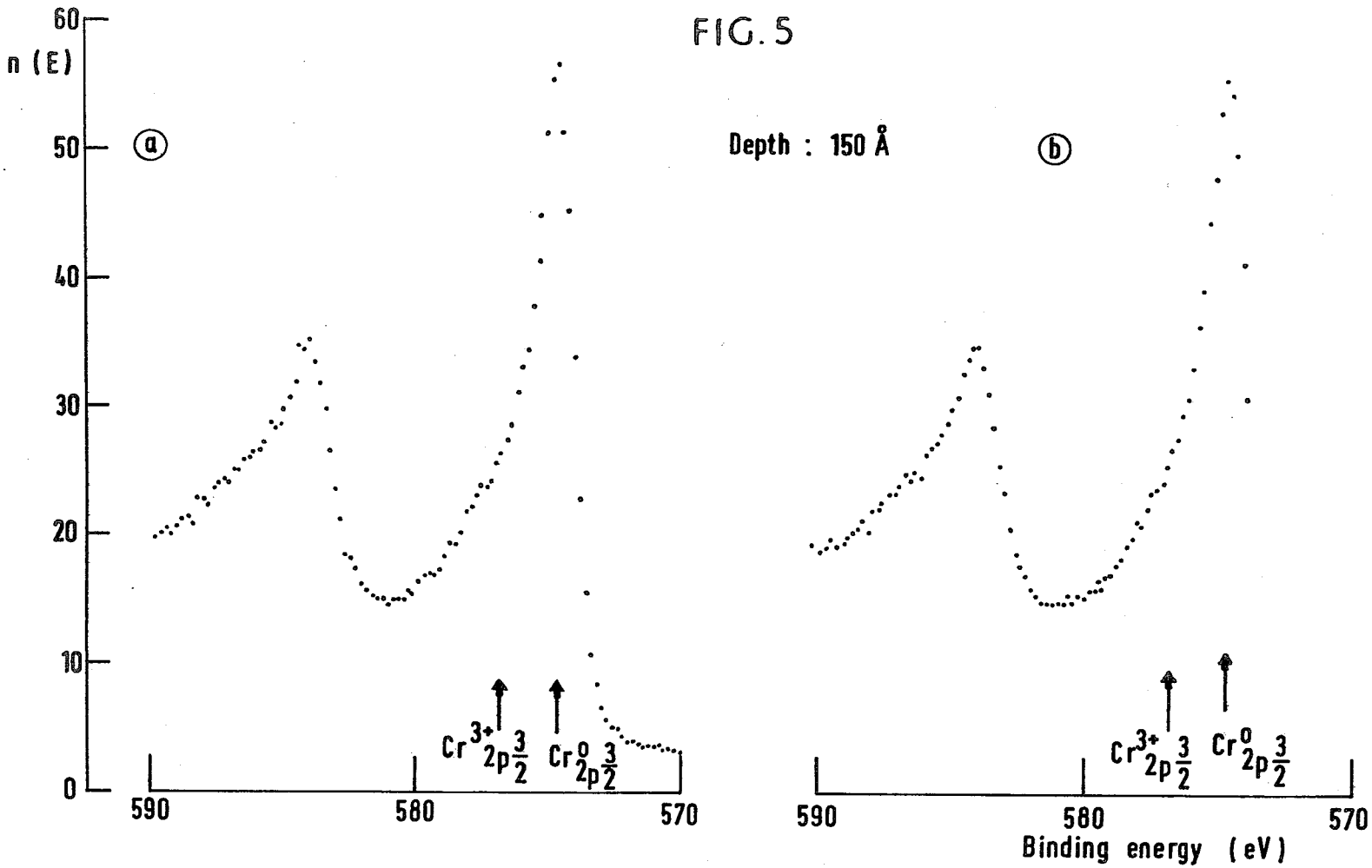
FIG. 5 is a graph of part of the photoelectronic spectrum of chromium for a chromatized strip with and without ageing.

By way of example, FIG. 5 shows the partial photoelectronic spectrum of chromium recorded at the same distance beneath the initial surface in the case of a strip treated in a chromic acid bath, (a) without and (b) with ageing treatment for 4 seconds at 400° C. in a $N_2$–5% $H_2$ atmosphere.

It will be noted that the ratio $Cr^O/Cr^{3+}$ remains unchanged in the layers examined, in spite of the ageing treatment.

We claim:

1. A process for surface-treating a metal strip and coating it with a metal layer, comprising the following steps;

(a) heating the strip to a temperature above 300° C.; and (b) immersing the strip in an aqueous coating bath having a temperature of at least 80° C. and containing at least one metal salt, the strip being coated with a metal layer by the coating bath.

2. A process as claimed in claim 1, in which the metal layer is nickel-based.

3. A process as claimed in claim 2, in which the coating bath contains:

at least one nickel salt in a concentration within a range from 5 to 50 g/l;

a reducing agent in a concentration greater than 0.1 mole/liter;

a buffer component comprising at least one substance selected from the group consisting of an alkali salt of a dibasic organic acid having the general formula $CO_2H—(CH_2)_n—CO_2H$, in which n=1 to 4, sodium hydroxyacetate ($NaC_2H_3O_3$), sodium acetate ($CH_3CO_3Na.3H_2O$), alkali salts of glycolic acid ($HOCH_2COOH$), citric acid, lactic acid, and propionic acid.

4. A process as claimed in claim 2, in which the coating bath comprises a solution for displacement-nickelling, containing a nickel salt and an acid and having a pH of 2 to 5.

5. A process as claimed in claim 2, in which the strip is a steel strip.

6. A process as claimed in claim 2, the process being carried out in the course of a thermal treatment in which the strip is introduced into a hot aqueous solution to cool it rapidly after recrystallization treatment and in which it is optionally introduced subsequently into another hot aqueous solution to effect final cooling, after thermal ageing treatment, at least one of the said solutions being used as a nickelling bath.

7. A process as claimed in claim 2, for forming a layer of low thickness and high nickel content, in which a single immersion lasting from 0.5 to 40 seconds is effected, counted from the instant when the temperature of the sheet reaches 150° C.

8. A process as claimed in claim 2, the process being carried out in the course of a thermal treatment comprising quenching in a hot aqueous solution followed by ageing, the process being effected after ageing to avoid diffusion of the nickel.

9. A process as claimed in claim 2, the process being carried out in the course of a thermal treatment comprising quenching which follows the heating for recrystallization, but without tempering, the quenching comprising the immersion of the strip in the said coating bath.

10. A process as claimed in claim 2, for forming a precipitation-hardened metal based layer, in which the immersion in the coating bath is followed by reheating to a temperature of 300° to 500° C.

11. A process as claimed in claim 2, in which the metal strip is steel strip for deep drawing, the process comprising the following steps:

(a) heating to a temperature above the recrystallization temperature and holding at this temperature, under a protective atmosphere;

(b) quenching in the said coating bath, the bath being at a temperature of at least 80° C., with a residence time of 0.5 to 40 seconds at a temperature below 150° C.;

(c) rinsing of the strip after it leaves the bath; and (d) ageing the strip by heating it to a temperature of 300° to 500° C.

12. A process as claimed in claim 2, further comprising forming a layer of copper which enhances adhesion of a subsequent coating.

13. A process as claimed in claim 12, in which the copper layer is formed following the formation of a nickel-based layer.

14. A process as claimed in claim 1, further comprising effecting a chromatizing treatment in a solution containing $Na_2Cr_2O_7$ or $CrO_3$ in a concentration of 10 to 100 g/l, in the presence of $SO_4$ ions in a concentration substantially 100 times lower, and with a current density of the order of 10 A/dm$^2$, the strip being cathodic.

15. A process as claimed in claim 14, in which the chromatizing treatment is effected during first cooling and/or during second cooling or following the latter.

16. A process as claimed in claim 1, in which the metal layer is chromium-based.

17. A process as claimed in claim 16, in which the coating bath contains chromic acid in solution.

18. A process as claimed in claim 17, in which the coating bath also contains at least one reducing agent.

19. A process as claimed in claim 18, in which the chromic acid concentration is 10 to 100 g/l.

20. A process as claimed in claim 17, in which the metal strip immersed in the bath is subjected to cathodic electrolysis, in the presence of sulphuric acid.

21. A process as claimed in claim 20, in which the immersion is carried out in two phases, the first of which comprises immersion in a $CrO_3$ medium titrating 50 to 500 g/l and the second of which comprises immersion in a solution of hexavalent chromium under cathodic polarization.

22. A process as claimed in claim 20, in which the immersion is carried out in a single phase by immersing the strip under cathodic polarization at low concentration with addition of at least one substance selected from the group consisting of sulphates, silicon fluoride, and boron fluoride.

23. A process as claimed in claim 17, further comprising subjecting the strip to ageing treatment under a reducing atmosphere whose dewpoint is from −10° C. to −40° C. in order to avoid oxidation of the metal layer.

24. A process as claimed in claim 16, the process being carried out in the course of thermal treatment during which the strip is introduced into a hot aqueous solution in order to cool it rapidly following recrystallization treatment and wherein it is optionally introduced subsequently into another hot aqueous solution to effect final cooling, following thermal ageing treatment, at least one of the said solutions being used as a chromatization bath.

25. A process as claimed in claim 16, the process being carried out in the course of thermal treatment comprising quenching in hot aqueous solution followed by ageing, the chromatization being effected after the ageing operation in order to avoid diffusion of chromium.

26. A process as claimed in claim 16, the process being carried out in the course of thermal treatment comprising quenching which follows recrystallization heating, but without tempering the chromatization being effected during the said quenching.

* * * * *